United States Patent [19]

Kanda

[11] Patent Number: 4,467,553

[45] Date of Patent: Aug. 28, 1984

[54] COOKING TOY

[75] Inventor: Shuichi Kanda, Tokyo, Japan

[73] Assignee: Takara Co., Ltd., Tokyo, Japan

[21] Appl. No.: 369,477

[22] Filed: Apr. 19, 1982

[51] Int. Cl.[3] ..... A63H 3/52

[52] U.S. Cl. ..... 446/136; 446/481

[58] Field of Search ..... 46/240, 239, 238, 236, 46/45, 14, 39, 248, 241

[56] References Cited

U.S. PATENT DOCUMENTS 2,323,837 7/1943 Neal ..... 46/238 X 3,774,338 11/1973 Waak ..... 46/14

4,333,258 6/1982 McCaslin ..... 46/14

*Primary Examiner*—Mickey Yu

*Attorney, Agent, or Firm*—Jackson, Jones & Price

[57] ABSTRACT

A cooking toy having a motor-driven magnet beneath a simulated cooking element is disclosed. Various food preparation devices having magnets therein can be placed on the simulated cooking element that provide motions indicative of food preparation in response to the rotation of the motor-driven magnet. Simulated food members having a magnetic portion is also provided.

8 Claims, 6 Drawing Figures

COOKING TOY

BACKGROUND OF THE INVENTION

1. Field of the Invention

The present invention is directed to a cooking toy, and particularly to a cooking toy that provides motions indicative of food preparation.

2. Description of the Prior Art

The toy industry has, over the years, provided cooking toys which were utilized to simulate food preparation activities. Generally, such cooking toys included small-scale model of stoves, ovens and pots and pans.

However, the prior art generally does not provide cooking toys that provided motions that are indicative of food preparation. Thus, the prior art did not provide a cooking toy which produced motions indicative of food preparation. Further, the prior art failed to provide a cooking toy wherein different cooking utensils could be utilized for producing different motions indicative of food preparation.

SUMMARY OF THE INVENTION

It is, therefore, an object of the present invention to provide an improved cooking toy which produces motions indicative of food preparation.

It is a further object of the present invention to provide an improved cooking toy wherein different cooking utensils produce different motions indicative of food preparation.

The foregoing and other objects of the present invention are accomplished in a cooking toy having motor-driven rotating magnet located beneath a simulated cooking element of a simulated stove top. Various cooking and food preparing devices can be placed on the simulated cooking element. By way of example, such devices include a toy cooking pan with a magnetic portion, a toy blender with a simulated blade having a magnetic portion, and a toy oven for receiving a simulated food product with a magnetic portion. When one of such cooking and food preparing devices is on the simulated cooking element, the rotation of the magnet beneath the simulated cooking element causes motions indicative of food preparation.

BRIEF DESCRIPTION OF THE DRAWINGS

The various advantages and features of the present invention will be readily appreciated by persons skilled in the art from the following detailed description when read in conjunction with the drawings wherein.

DETAILED DESCRIPTION OF THE INVENTION

Figure 1:
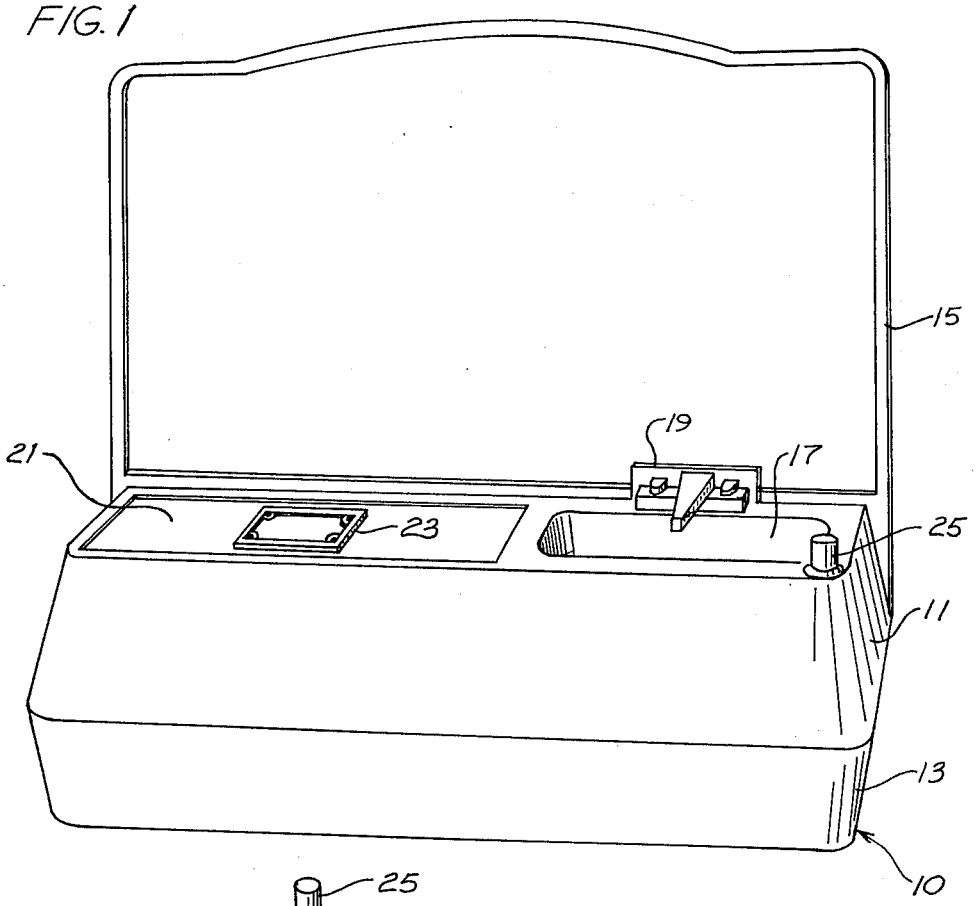
FIG. 1 is a front perspective view of the external structure of the stove portion of the disclosed cooking toy.

In the following detailed description, like elements in different figures will be referred to by like reference numerals.

FIG. 1 shows a toy stove 10 that includes a housing that has a top section 11 and a bottom section 13. By way of example, the top and bottom housing sections 11 and 13 can be of molded plastic that are appropriately joined by screw fasteners. The top housing section 11 includes a vertical wall 15.

The top housing section further includes a toy kitchen sink 17 and a toy faucet 19. Adjacent the sink 17 is a stove top 21 that includes a simulated heat element 23. Extending through one corner of the top housing section 11 is a switch actuator 25.

Figure 2:
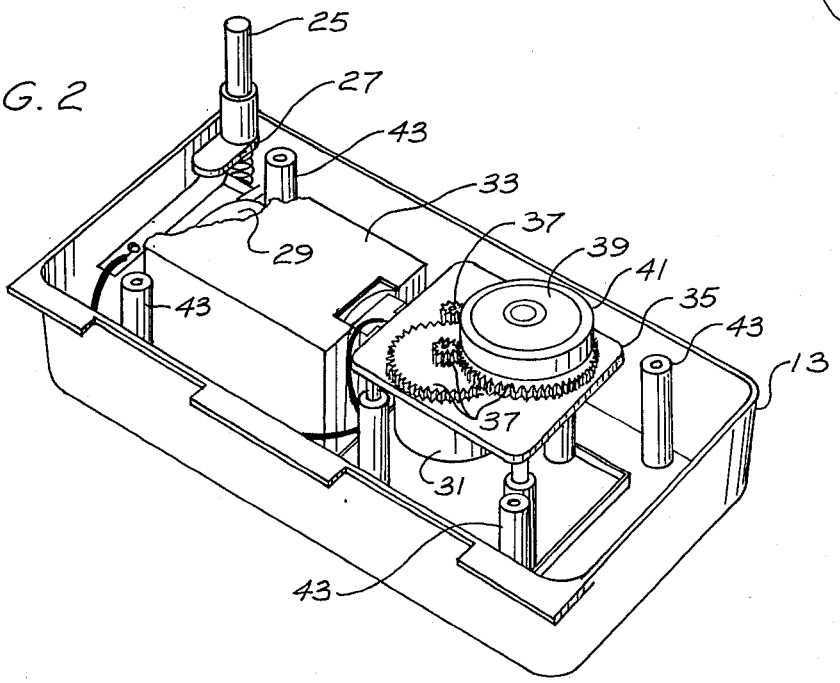
FIG. 2 is a rear perspective view of the internal structure of the stove portion of the disclosed cooking toy.

Referring now to FIG. 2, the bottom housing section 13 contains a switch 27 that is controlled by the switch actuator 25. The switch 27 controls the power from a battery 29 to an electric motor 31. The battery is enclosed in a battery housing 33 that preferably is accessible from the bottom of the bottom housing 13.

The electric motor 31 is mounted below a platform 35 that in turn is mounted to the bottom housing section 13. The electric motor 31 drives a plurality of gears 37 for ultimately driving a circular magnet 39 that is mounted to a non-magnetic support 41. By way of example, each pole of the magnet 39 is semicircular.

A plurality of mounting posts 43 are provided for attaching the bottom housing section 13 to the top housing section 11. The magnet 39 is located so as to be beneath the simulated heating element 23, and it should be noted again that FIG. 2 is a rear perspective view.

Figure 3:
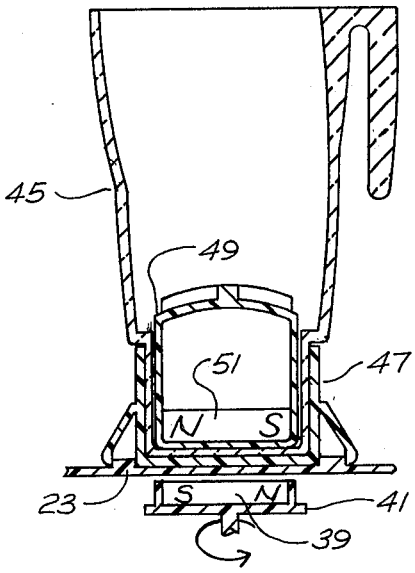
FIG. 3 is a cross-sectional view of a toy blender as it is used with the stove portion shown in FIGS. 1 and 2.

FIG. 3 illustrates a toy blender that includes a transparent container 45 and a base 47. Inside the container 45 is a simulated blade assembly 49 that contains a magnetic portion 51 in its base. The toy blender can be placed on the simulated heating element 23. Thus, when the magnet 39 is rotated, the simulated blade assembly 49 will also rotate.

Figure 4:
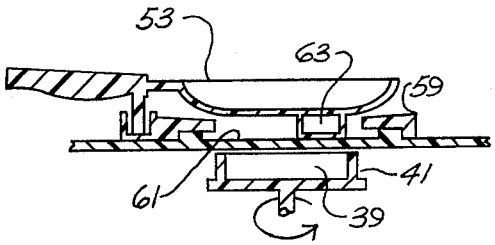
FIG. 4 is a cross-sectional view of a toy cooking pan as it is used with the stove portion shown in FIGS. 1 and 2.

Referring now to FIG. 4, shown therein is a toy cooking pan 53 and a simulated burner grate 59. Part of the cooking pan 53 extends into a cavity 61 in the burner grate 59. The cooking pan 53 further includes a magnetic portion 63 at the bottom that is off-center relative to the axis of rotation of the magnet 39. The rotation of the magnet 39 will cause the cooking pan 53 to move around.

Figure 5:
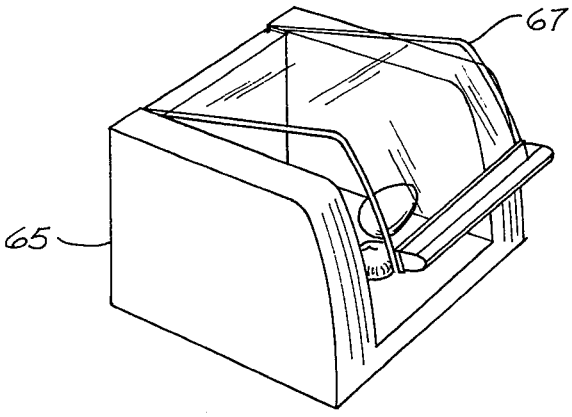
FIG. 5 is a perspective view of a toy oven that is used with the stove portion shown in FIGS. 1 and 2.

FIG. 5 shows a toy oven 65 that has a hinged transparent cover 67. Simulated food products can therefore be placed within the toy oven 65. The toy oven 65 is intended to be selectively placed on the simulated heating element 23 of FIG. 1 and like the toy blender and cooking pan has a base configured to mount over and be retained by the burner heating element 23.

Figure 6:
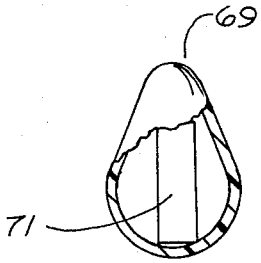
FIG. 6 is a partial cross-sectional view of a simulated food product that is used with the toy oven of FIG. 5.

FIG. 6 is a partial cross-sectional view of a simulated food product 69 that is placed in the toy oven 65 when it is placed on the simulated heating element 23. The simulated food product contains a magnetic portion 71. The rotation of the magnet 39 will cause the simulated food product 69 to move around inside the toy oven 65.

The motions produced by the foregoing food preparing devices are indicative of food preparing activities and achieve a more realistic simulation of food preparing activities.

Although the foregoing has been a description of certain embodiments of the present invention, changes and modifications thereto can be readily made by persons skilled in the art without departing from the scope of the present invention as defined by the following claims.

What is claimed is:

1. A simulated toy kitchen assembly set comprising:

a housing member simulating the appearance of a toy stove including a burner element;

a first magnetic member movably mounted beneath the burner element;

a motor connected to the magnetic member for driving the same;

at least one simulated food member having a magnetic portion; and a plurality of simulated kitchen appliances each having a base configured to mount over the burner element and capable of being removably mounted over the burner element, at least one or more of the simulated kitchen appliances having a second magnetic member to provide an interaction and movement indicative of food preparation when the motor is activated and the simulated food member is positioned in the simulated kitchen appliances.

2. The simulated toy kitchen assembly set of claim 1 wherein the first magnetic member has a circular configuration.

3. The simulated toy kitchen assembly set of claim 1 wherein said toy stove further includes a simulated kitchen sink attached thereto.

4. A cooking toy comprising:

first magnetic means;

motor means for rotating said first magnetic means; and second magnetic means responsive to said first magnetic means, said second magnetic means further providing motions indicative of food preparation and comprising a toy oven having simulated food therein, said simulated food having a magnetic portion.

5. The cooking toy of claim 4 wherein said first magnetic means includes a circular magnet.

6. A cooking toy comprising:

a toy stove top having a simulated cooking element;

first magnetic means rotably mounted beneath said simulated cooking element;

motor means for rotating said first magnetic means;

simulated food members having a magnetic portion; and second magnetic means in the form of a simulated toy oven having simulated food members therein for selective placement on said simulated cooking element and responsive to said first magnetic means for providing motions indicative of food preparation.

7. The cooking toy of claim 6 wherein said toy stove top further includes a simulated kitchen sink.

8. The cooking toy of claim 6 wherein said first magnetic means includes a circular magnetic.

* * * * *